US006474788B1

(12) United States Patent
Saito et al.

(10) Patent No.: US 6,474,788 B1
(45) Date of Patent: Nov. 5, 2002

(54) SUBSTRATE FOR USE OF INK JET HEAD, INK JET HEAD, INK JET CARTRIDGE, AND INK JET RECORDING APPARATUS

(75) Inventors: Ichiro Saito; Masanori Takenouchi, both of Yokohama; Yoshiyuki Imanaka, Kawasaki; Osamu Iwasaki, Tokyo; Shin Ishimatsu, Yokohama; Ryoji Inoue, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/429,286

(22) Filed: Oct. 28, 1999

(30) Foreign Application Priority Data

Nov. 4, 1998 (JP) ..... 10-313808

(51) Int. Cl.[7] ..... B41J 2/05
(52) U.S. Cl. ..... 347/58
(58) Field of Search ..... 347/58–59, 20, 347/50, 85, 63, 65, 87, 47, 94, 44

(56) References Cited

U.S. PATENT DOCUMENTS

| | | | | |
|---|---|---|---|---|
| 4,723,129 A | | 2/1988 | Endo et al. | 347/56 |
| 4,740,796 A | | 4/1988 | Endo et al. | 347/56 |
| 6,007,187 A | * | 12/1999 | Kashino | 347/65 |
| 6,070,968 A | * | 6/2000 | Akino et al. | 347/59 |

FOREIGN PATENT DOCUMENTS

| | | |
|---|---|---|
| EP | 0 707 964 A2 | 4/1996 |
| EP | 0 816 110 A1 | 1/1998 |
| JP | 62-261452 | 11/1987 |
| JP | 62-261453 | 11/1987 |
| JP | 9-239983 | 9/1997 |

OTHER PUBLICATIONS

Takahashi Wataru, "Ink Jet Recording Head, Ink Jet Recording Head Cartridge and Ink Jet Recording Apparatus", Patent Abstracts of Japan, European Patent Office, 09 239983 A, Sep. 16, 1997, Abstract.

* cited by examiner

*Primary Examiner*—Michael Nghiem
*Assistant Examiner*—K. Feggins
(74) *Attorney, Agent, or Firm*—Fitzpatrick, Cella, Harper & Scinto

(57) ABSTRACT

A substrate for use of an ink jet head that constitutes an ink jet head includes a plurality of discharge ports for discharging liquid, a plurality of liquid flow paths communicated with the plurality of discharge ports, and first and second heat generating device arranged serially in the liquid flow paths in the flow path direction of the liquid flow paths for generating thermal energy which is utilized for discharging liquid in the liquid flow paths from the discharge ports, the first and second heat generating device being formed on the substrate. For this substrate, the first and second heat generating device are driven at driving frequencies of 4 kHz or more, and the first heat generating device are arranged in parallel in the direction perpendicular to the flow path direction of the liquid flow paths, and at the same time, structured with a plurality of heat generating resistive members electrically connected in series, and the second heat generating device is structured with at least one heat generating resistive member. With the structure thus arranged, this substrate makes it possible not only to stabilize liquid discharges even for the execution of a multi-valued recording, but also, provide the heat generating resistive members and liquid flow paths in higher densities.

20 Claims, 9 Drawing Sheets

SUBSTRATE FOR USE OF INK JET HEAD, INK JET HEAD, INK JET CARTRIDGE, AND INK JET RECORDING APPARATUS

BACKGROUND OF THE INVENTION

1. Field of the Invention

The present invention relates to a substrate for use of an ink jet head that constitutes the ink jet head that records or prints images, such as characters and symbols, by discharging ink or some other functional liquid onto recording media, such as papers, plastics, cloths, or some other materials adoptable as print objects. The invention also relates to an ink jet head structured by use of the ink jet head substrate, an ink jet cartridge that includes an ink storing unit to store ink to be supplied to the ink jet head, as well as to an ink jet recording apparatus having the ink jet head installed thereon.

In this respect, the ink jet cartridge referred to in the specification of the invention hereof is formed detachably on mounting means, such as a carriage, arranged on the apparatus main body.

Also, the ink jet recording apparatus referred to in the specification of the invention hereof means not only the one formed integrally with an information processing apparatus, such a word processor, computer, as the output terminal thereof or formed separately therefrom, but also, means the one that includes the mode in which the ink jet recording apparatus is used for various equipment, such a copying machine having information reading devices combined therewith, a facsimile apparatus having the information transmitting and receiving functions therefor, and an apparatus that prints on textiles, among some others.

2. Related Background Art

The conventional ink jet recording apparatus uses the electrothermal converting members or piezo elements as the energy generating means that generates energy to be utilized for discharging ink. Then, it is arranged for the apparatus to enable the energy generated by this energy generating means to act upon ink or some other liquid to discharge liquid from the discharge ports. An ink jet recording apparatus of the kind is characterized in that it can record images in high precision at high speeds by discharging ink or other liquid from the discharge ports as fine liquid droplets at high speeds. The ink jet recording apparatus of the type, which uses electrothermal converting members as energy generating means that generates energy to be utilized for discharging ink, and discharges liquid by the utilization of bubbling of ink crated by the thermal energy generated by use of these electrothermal converting members, is particularly suitable for making highly precise images at higher recording, as well as suitable for making an ink jet head and the ink jet recording apparatus smaller and capable of using colors. Therefore, the ink jet recording apparatus of the type has attracted more attention in recent years. The ink jet recording apparatus that uses electrothermal converting members is disclosed in the specification of U.S. Pat. No. 4,723,129 or U.S. Pat. No. 4,740,796, for example.

FIG. 9 is a cross-sectional view which illustrates the conventional ink jet head. As shown in FIG. 9, the conventional ink jet head is provided with a plurality of discharge ports 701. Also, the electrothermal converting elements 702 that generate thermal energy utilized for discharging ink from each of the discharge ports 701 are formed on the surface of the substrate 704 per ink flow path 703 that serves as each of the liquid flow paths communicated with each of the discharge ports 701. The electrothermal converting element 702 mainly comprises a heat generating resistive element 705, the electrode wiring 706 that supplied electric power to the heat generating resistive element 705, and the insulation film 707 that protects the heat generating resistive element 705 and the electrode wiring 706. For the ink jet head of the kind, there is formed the ink jet head substrate which is provided with the substrate 704, and electrothermal converting elements 702 arranged on the substrate 704, among some others.

Also, each of the ink flow paths 703 is formed with the ceiling plate having a plurality of flow path walls 708 are formed integrally therewith, which is bonded to the substrate 704. When the substrate 704 is bonded to the ceiling plate, the electrothermal converting elements 702 and others on the substrate 704 are relatively positioned with the ceiling plate by means for image processing or the like, while being bonded to the ceiling plate. Each end portion of the ink flow paths 703 on the side opposite to the discharge ports 701 is communicated with the common liquid chamber 709. Ink supplied from the ink tank (not shown), which serves as an ink storing unit, is retained in this common liquid chamber 709.

The ink which is supplied to the common liquid chamber 709 is introduced into each of the ink flow paths 703 from the common liquid chamber 709. Then, the ink is held in each ink flow path 703 by means of the meniscus formed in the vicinity of each discharge port 701 in the flow path 703. Each of the electrothermal converting elements 702 is selectively driven, while ink is kept in each of the ink flow paths 703. Thus, by the utilization of thermal energy generated by each of the heat resistive elements 705, ink on the heat generating resistive element 705 is abruptly heated to boil. By the force of impact, ink is, then, discharged from each of the discharge ports 701.

FIG. 10 is a linear cross-sectional view which shows the portion of the substrate for use of an ink jet head used for the ink jet head illustrated in FIG. 9, which corresponds to the ink flow path 703, taken along line X—X in FIG. 9. In FIG. 10, the ink jet head substrate formed by the substrate 704 and the electrothermal converting elements 702 shown in FIG. 9 corresponds to the substrate 720 for use of an ink jet head.

As shown in FIG. 10, the heat accumulation layer 722 formed by thermal oxidation film is formed on the surface of the silicon substrate 721 for the substrate 720 for use of an ink jet head. On the surface of the heat accumulation layer 722, the interlayer film 723 is formed by the SiO film that dually functions to accumulate heat or formed by SiN film or the like. On the surface of the interlayer film 723, the heat generating resistive layer 724 is locally formed. On the surface of the heat generating resistive layer 724, Al, Al—Si, Al—Cu, or some other metallic wiring 725 is formed. On the metallic wiring 725, the heat generating resistive layer 724 and the interlayer film 723, the protection film 726 are formed with SiO film, SiN film, or the like. On the surface of the protection film 726, the cavitation proof film 727 are formed to protect the protection film 726 from the chemical and physical shocks that follow the heating of the heat generating resistive layer 724. The portion of the cavitation proof film 727 other than the portion corresponding to the metal wiring 725 on the heat generating resistive layer 724 becomes the thermal activation portion 728 where heat from the heat generating resistive layer 724 acts upon ink.

For the ink jet head described in conjunction with FIG. 9 and FIG. 10, each of the heat generating resistive elements 703 is arranged for each of the ink flow paths 705. Then, recording is performed by the utilization of heat generated by the heat generating resistive elements 705. For an ink jet head of the kind, there have been increasing demands in the availability of higher images, and higher densities. As a result, various experiments have been carried out to meet such demands. For example, there has been proposed a multi-valued recording method in the specifications of Japanese Patent Application Laid-Open Nos. 62-261452 and 62-261453 in which a plurality of heat generating elements are arranged for one liquid flow path so that the heat generating elements are selectively driven to change the sizes of the liquid droplets to be discharged from the discharge ports in accordance with the multi-valued information to be recorded.

Here, however, there are restrictions given below when a plurality of heat generating elements are arranged for one ink flow path in the liquid flow direction of ink flow paths in order to implement the multi-valued recording method where the heat generating elements are arranged in the ink flow path and selectively driven.

Now, hereunder, as to the restriction on the selective driving of a plurality of heat generating elements arranged for the ink flow path, the description will be made of an example in which the first and second heat generating elements are arranged in the ink flow path in the flow path direction of the ink flow paths so as to execute the binary recording with the large dots and smaller dots by driving these two heat generating elements selectively.

At first, in this case, in order to execute the multi-valued recording more effectively, it is desirable that each of the smaller dots should be as small as possible for the higher precision, while each of the larger dots should be made as large as possible for the higher speed recording. To this end, the area of the heat generating element for use of smaller dot recording should be made smaller, while it is needed to make the area larger for the heat generating element for use of large dot recording. In this respect, the width of the heat generating element for use of the larger dot recording in the direction orthogonal to the ink flow path is automatically determined by the width of the ink flow path at first.

Then, in consideration of the condition in which the first and second heat generating elements which should be driven, it is preferable to make the driving voltage applied to the first and second heat generating elements equal. Then, there is naturally a restriction encountered that the driving voltage should be made the same as to the first and second heat generating elements.

Now, taking these two restrictions into consideration, the description will be made of the example in which the first and the second heat generating elements are arranged on the substrate in conjunction with FIG. 11 and FIG. 12.

FIG. 11 is a plan view which illustrates the example of an ink jet head having the first and second heat generating elements formed on the substrate in substantially the same sheet resistance value. In FIG. 11, the direction indicated by an arrow A is the direction of ink discharges. As shown in FIG. 11, when the first heat generating element 781 and the second heat generating element 782 are arranged serially in the ink flow path in the flow path direction of the ink flow path in that order from the discharge port side, the length L1 of the first heat generating element 781 in the flow path direction of the ink flow path and the length L2 of the second heat generating element 782 in the flow path direction of the ink flow path should be made the same in order to make the driving voltage equal. Each of the first heat generating element 781 and the second heat generating element 782 is formed to be extended in the flow path direction of the ink flow path. With the structure thus arranged, the second heat generating element 782 is away from the discharge port if the length L1 of the first heat generating element 781 and the length L2 of the second heat generating element 782 are made equal. Therefore, if a larger dot should be discharged at a higher speed, this arrangement presents a restriction. Also, the width W1 of the first heat generating element 781 for use of smaller dots in the direction orthogonal to the flow path direction of the ink flow path becomes narrower than the width W2 of the second heat generating element 782 for use of larger dots in the direction orthogonal to the liquid flow path direction of the ink flow path. Therefore, even at the maximum bubbling of the first heat generating element 781, the bubble does not reach the nozzle walls. Consequently, when bubbling and debubbling are repeated at a higher speed (4 kHz or higher, for example) in order to increase the printing speed, it becomes difficult to exhaust bubbles in each of the nozzles, which presents a restriction when the performance of the head should be enhanced.

On the other hand, FIG. 12 is a plan view which illustrates the example of an ink jet head in which the first heat generating element and the second heat generating element are structured with different heat resistive layers. In FIG. 12, the direction indicated by an arrow B is the discharge direction of ink. In this case, as shown in FIG. 12, the sheet resistance value of the first heat generating element 791 for use of the smaller dots is made larger by changing the material and film thickness. Then, by making the with W3 of the first heat generating element 791 wider, and at the same time, the length L3 of the first heat generating element 791 shorter than the length L4 of the second heat generating element 792, it is made possible to arrange the first heat generating element 791 and the second heat generating element 792 to be in the positions nearer to the discharge port. However, the manufacturing processes become complicated to change the sheet resistance values for the first heat generating element 791 and the second heat generating element 792 as described above. Then, there is encountered a problem that the costs of the ink jet head substrate and the ink jet head become higher.

Further, a structure is disclosed in the specification of Japanese Patent Application Laid-Open No. 9-239983 in which the heat generating means for use of smaller dot formation is arranged to be the one having two heat generating resistive elements electrically connected in series which are provided in parallel to the liquid flow direction, and then, the heat generating means is arranged nearer to the discharge port side in the state where the driving voltage applicable to the first and second heat generating means is almost the same.

FIG. 13 is a plan view which illustrates the structure of the ink jet head disclosed in the specification of Japanese Patent Application Laid-Open No. 9-239983.

As shown in FIG. 13, the substrate for use of an ink jet head which constitutes the ink jet head is provided with the first heat generating means 801 for use of smaller dots formed by the first heat generating resistive member 801*a* and the second heat generating resistive member 801*b* arranged for the ink flow path 808 which serves as the liquid flow path, and the second heat generating member 802 which serves as the second heat generating means. The first heat generating means 801 and heat generating resistive member 802 are arranged in series in that order from the discharge port side 807 side in the flow path direction of the ink flow path 808. The end portion of the heat generating resistive member 802 on the first heat generating means 801 side is electrically connected with the common wiring 805, and the end portion of the heat generating resistive member 802 on the side opposite to the first heat generating means 801 side is electrically connected with the individual wiring 804.

The first heat generating resistive member 801*a* and the second heat generating restive member 801*b* are arranged in parallel in the flow path direction of the ink flow path 808.

However, it is not necessarily possible even for a head of the kind to demonstrate the anticipated effect when it is driven at higher frequency to perform the multi-valued recording. In other words, there is a need for an ink jet head to arrange the heat generating resistive member and wiring per one ink flow path 808 within the pitch of the ink flow path 808. Therefore, the length L5 in the width direction of the ink flow path 808 particularly for the first heat generating resistive member 801*a* and the second heat generating resistive member 802*b* is restricted by the pitch P of the ink flow path 808. In accordance with the structure shown in FIG. 13, there is a need for the arrangement of the connecting wiring 806 in addition to the common wiring 805 and the individual wiring 803 on both sides of the first heat generating means for use of the smaller dot formation. As a result, against the flow path width, it becomes difficult to obtain a sufficient width of the heat generating means in the direction orthogonal to the ink flow path direction. Thus, the restriction is encountered when the head is driven at higher frequency to execute the multi-valued recording as described above. Now, if it is intended to secure a larger width for the heat generating means structured as described above in the direction orthogonal to the ink flow path direction against the flow path width, it becomes necessary to make the width of wiring electrode narrower, which brings about the increase of the wiring resistance. Such arrangement is not favorable at all.

SUMMARY OF THE INVENTION

With a view to solving the problems discussed above, the present invention is designed. It is an of the invention to provide a substrate for use of an ink jet head capable of discharging ink stably even in the case where the head is driven at a high frequency for the multi-valued recording, and also, capable of making the heat generating resistive member and liquid flow paths in higher densities by making the width of the first heat generating means for use of smaller dot discharges wider in the direction orthogonal to the flow path direction of the ink flow path so as to locate each of them to be more closer to the nozzle walls, at the same time, making the length of the first heat generating means essentially shorter in the flow path direction. The invention is also aimed at providing an ink jet head that uses the substrate for use of an ink jet head, as well as an ink jet cartridge and an ink jet recording apparatus.

Also, it is another object of the invention to provide a substrate for use of an ink jet head that allows the designing freedom to be increased as to the arrangement and structure of the first heat generating means for use of the smaller dot discharges, as well as the second heat generating means for use of the large dot discharges, while making it possible to reduce the costs of manufacture, and also, to provide an ink jet head, an ink jet cartridge, as well as an ink jet recording apparatus.

In order to achieve these objectives, a substrate of the present invention for use of an ink jet head that constitutes an ink jet head comprises a plurality of discharge ports for discharging liquid, a plurality of liquid flow paths communicated with the plurality of discharge ports, and first and second heat generating means arranged serially in the liquid flow paths in the flow path direction of the liquid flow paths for generating thermal energy utilized for discharge liquid in the liquid flow paths from the discharge ports, the first and second heat generating means being formed on the substrate. For this substrate, the first and second heat generating means are driven at driving frequencies of 4 kHz or more, and the first heat generating means are arranged in parallel in the direction perpendicular to the flow path direction of the liquid flow paths, at the same time, being structured with a plurality of heat generating resistive members electrically connected in series, and the second heat generating means is structured with at least one heat generating resistive member.

It is preferable to make each sheet resistance value of the heat generating resistive members forming the first heat generating means, and the sheet resistance value of the heat generating resistive member forming the second heat generating means substantially the same.

More specifically, it is preferable to enable the substrate to further comprise a common wiring layer formed on the substrate to be arranged on the substrate side of the first and second heat generating means; an insulating layer formed on the surface of the common wiring layer to be arranged as the lower layer of the first and second heat generating means; a first through hole formed on the insulating layer between the first and second heat generating means for electrically connecting the first and second heat generating means with the common wiring layer; a first individual wiring formed on the surface of the insulating layer to be electrically connected with the first heat generating means; a second individual wiring formed on the surface of the insulating layer to be electrically connected with the second heat generating means; a common wiring arranged on the side of the second heat generating means opposite to the discharge port side; and a second through hole formed on the portion of the insulating layer corresponding to the end portion of the common wiring on the second heat generating means side to electrically connect the common wiring and the common wiring layer, and then, the first heat generating means is arranged on the downstream side than the second heat generating means in the flow path direction of the liquid flow path.

Also, it is preferable to structure the first heat generating means with first and second heat generating resistive members arranged in parallel to the direction perpendicular to the flow path direction of the liquid flow path, and the first and second heat generating resistive members are electrically connected through connecting wire arranged on the discharge port side of the first and second heat generating resistive members.

Further, it is preferable to make the widths of the first and second heat generating resistive members substantially the same, and the second heat generating means is formed by one heat generating resistive member, and also, to make the length of the second heat generating means in the flow path direction of the liquid flow path substantially the same as the total length of the first and second heat generating resistive members in the flow path direction of the liquid flow path.

Further, either one of TaN, TaAl, TaSiN and $HfB_2$ is used as the structural material of the first and second heat generating elements.

Moreover, it is preferable to make the free bubbling width of the first heat generating means larger than the maximum distance of the liquid flow path in the width direction of the liquid flow path on the arrangement portion of the first heat generating means, and also, to make the configurations and sizes of the first heat generating resistive member and the second heat generating resistive member substantially the same.

In order to achieve the objectives of the present invention, a substrate for use of an ink jet head that constitutes an ink jet head comprises a plurality of discharge ports for discharging liquid, a plurality of liquid flow paths communicated with the plurality of discharge ports, and first and second heat generating means arranged serially in the liquid flow path in the flow path direction of the liquid flow paths for generating thermal energy which is utilized for discharging liquid in the liquid flow paths from the discharge ports, the first and second heat generating means being formed on the substrate. This substrate for use of an ink jet head is provided with a common wiring layer formed on the substrate to be arranged on the substrate side of the first and second heat generating means; an insulating layer formed on the surface of the common wiring layer to be arranged as the lower layer of the first and second heat generating means; a first through hole formed on the insulating layer between the first and second heat generating means for electrically connecting the first and second heat generating means with the common wiring layer; a first individual wiring formed on the surface of the insulating layer to be electrically connected with the first heat generating means; a second individual wiring formed on the surface of the insulating layer to be electrically connected with the second heat generating means, and at the same time, the first and second heat generating means are driven at driving frequencies of 4 kHz or more, and the first heat generating means are structured with a plurality of heat generating resistive members electrically connected in series, and the second heat generating means is structured with at least one heat generating resistive member.

Also, each sheet resistance value of the heat generating resistive members forming the first heat generating means, and the sheet resistance value of the heat generating resistive member forming the second heat generating means are substantially the same.

Also, the first heat generating means is arranged on the downstream side than the second heat generating means in the flow path direction of the liquid flow path.

Also, the first heat generating means is structured with first and second heat generating resistive members arranged in parallel to the direction perpendicular to the flow path direction of the liquid flow path, and the first and second heat generating resistive members are electrically connected through connecting wire arranged on the discharge port side of the first and second heat generating resistive members.

Also, the widths of the first and second heat generating resistive members are substantially the same, and the second heat generating means is formed by one heat generating resistive member, and the length of the second heat generating means in the flow path direction of the liquid flow path is substantially the same as the total length of the first and second heat generating resistive members in the flow path direction of the liquid flow path.

Also, either one of TaN, TaAl, TaSiN and $HfB_2$ is used as the structural material of the first and second heat generating elements.

Also, the free bubbling width of the first heat generating means is larger than the maximum distance of the liquid flow path in the width direction of the liquid flow path on the arrangement portion of the first heat generating means, and the configurations and sizes of the first heat generating resistive member and the second heat generating resistive member are substantially the same.

In accordance with the present invention described above, the first and second heat generating means are serially arranged in the flow path direction of the ink flow path, and the first heat generating means is arranged in the direction perpendicular to the flow path direction of the ink flow path. More specifically, this heat generating means is structured by the first heat generating resistive member and the second heat generating resistive member arranged in parallel in the width direction of the ink flow path. In this way, it becomes possible to make the length of the first heat generating means essentially shorter in the flow path direction. Also, the width of each of the heat generating resistive members of the first heat generating means can be made wider. As a result, the first heat generating means can be located nearer to the nozzle walls, and also, the first heat generating means and the heat generating resistive member can be arranged nearer to the discharge port along the ink flow path, hence reducing the fluid resistance toward the discharge port in order to implement the stabilization of discharges when the head should be driven at higher frequencies for the execution of a multi-valued recording. Moreover, each of the heat generating resistive members that form the first heat generating means is arranged in parallel to the direction perpendicular to the flow path direction. As a result, the connecting wiring that connects these heat generating resistive members themselves can be arranged on the discharge port side of the first heat generating means to make it possible to reduce the number of winging that should be arranged in the width direction of the ink flow path as compared with the case where each of the heat generating resistive members of the first heat generating means are arranged in parallel to the flow path direction. Therefore, the width of each heat generating resistive member can be made larger in relation to the width of the ink flow path, hence implementing the stabilization of discharges. Also, it becomes possible to attain the provision of higher density of the ink flow paths, and heat generating members as well. Furthermore, since the width of each heat generating resistive member can be made larger, it becomes possible to arrange the first and second heat generating means more closely to the discharge port side. This arrangement that makes it possible to locate the first and second generating means more closely to the discharge port side along the ink flow path indicates that the arrangement, configuration, and size of each heat generating member can be changed within a range that does not lower its discharge characteristics. In other words, it becomes possible to enhance the freedom in designing the heat generating resistive members for the attainment of a multi-valued recording. In this manner, it becomes possible to increase the designing freedom in consideration of the balance between each of the heat generating means up to the maximum of such increased freedom as to the arrangement and structure of the first and second heat generating means. Consequently, in addition to the stabilized liquid discharges for a multi-valued recording, the heat generating resistive members and liquid flow paths can be arranged in higher density.

Also, as the structural material of the first and second heat generating means, the one having almost the same sheet resistance value is used unlike the conventional means where a plurality of heat generating resistive members are adopted with different sheet values. As a result, it becomes possible to suppress the manufacturing costs of the substrate for use of an ink jet head, the ink jet head, and the ink jet cartridge.

Further, the structure is adopted so that the first and second heat generating means are arranged serially on the common wiring layer with the first through between the first and second heat generating means. Therefore, it becomes possible to locate the first and second heat generating means more closely to the discharge ports within the limited width of each of the liquid flow paths. In this way, the aforesaid effects can be demonstrated. In addition, the number of wires arranged in the width direction of liquid flow path can be made smaller. To that extent, then, the width of each of the heat generating resistive members can be made wider in relation to the width of each liquid flow path, hence implementing the stabilized discharges, at the same time, attaining the provision of higher density for the liquid flow paths and the heat generating resistive members as well.

Further, an ink jet head of the present invention comprises a substrate for use of an ink jet head described above, and a ceiling plate bonded to the surface of the substrate for use of an ink jet head on the first and second heat generating means side so as to arrange the liquid flow paths on the surface of the substrate for use of an ink jet head on the first and second heat generating means side.

Further, an ink jet cartridge of the present invention comprises an ink jet head described above, and a liquid storing unit to store liquid to be supplied to the ink jet head.

Further, an ink jet recording apparatus of the present invention comprises an ink jet cartridge described above, and a recording medium carrier device for carrying a recording medium to receive liquid discharged from the ink jet head of the ink jet cartridge.

In accordance with each of the above-described inventions, it is possible to discharge liquid stably for recording even when a multi-valued recording is required, and also, it becomes possible to obtain an ink jet head, an ink jet cartridge, and an ink jet recording apparatus, with which to execute recording of highly precise images in higher resolution.

In this respect, the phrase "the free bubbling width of heat generating means" referred to in the specification of the invention hereof indicates the maximum development of a bubble which is bubbled by heat generating means in the state where there is essentially no fluid resistive component on the circumference thereof.

DETAILED DESCRIPTION OF THE PREFERRED EMBODIMENTS

Now, with reference to the accompanying drawings, the description will be made of the embodiments in accordance with the present invention.

(First Embodiment)

Figure 1:
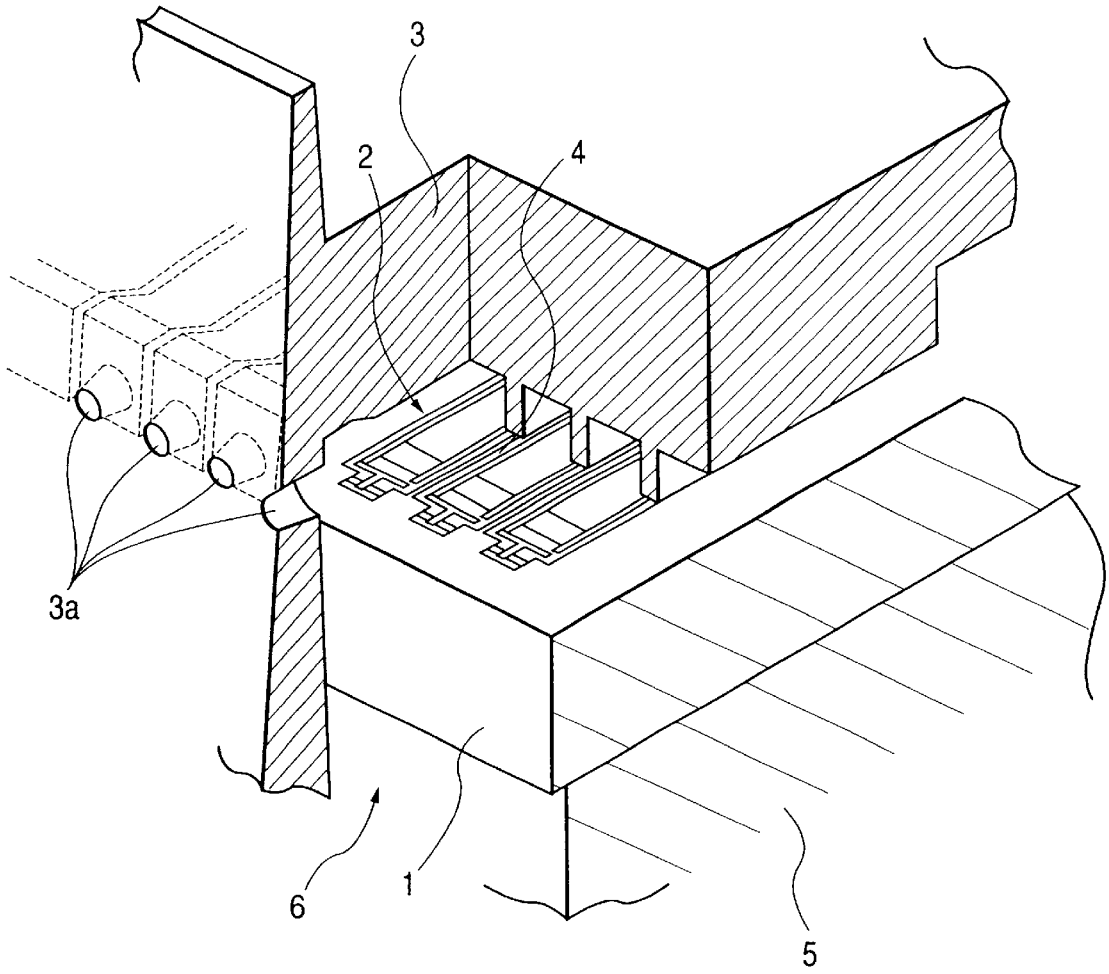
FIG. 1 is a partially broken perspective view which shows the principal part of the ink jet head in accordance with a first embodiment of the present invention.

FIG. 1 is a partially broken perspective view which shows the ink jet head in accordance with a first embodiment of the present invention. As shown in FIG. 1, the silicon substrate 1 is bonded with an adhesive agent having a good heat conductivity to the aluminum plate 5 which is the heat radiation member for the ink jet head of the present embodiment. On the surface of the silicon substrate 1, a plurality of discharge means are formed by a plurality of heat generating resistive members, wiring, and the like to be described later in conjunction with FIG. 2. The discharge means 2 is to generate thermal energy to be utilized for discharging ink or some other liquid. On the silicon substrate 1, a driving circuit (not shown) is incorporated in order to drive each of the discharge means 2. The driving circuit is electrically connected with the terminals (not shown) formed on the rear end portion (end portion on the side opposite to the discharge port 3*a* side) of the silicon substrate 1. The substrate 6 for use of the ink jet head is structured by the silicon substrate 1, the discharge means 2 formed on the silicon substrate 1, and the driving circuit, among some others.

To the surface of the substrate 6 for use of the ink jet head on the discharge means 2 side, the ceiling plate 3 is bonded with a plurality of grooves that form ink flow paths 4 each serving as the liquid flow path for each of the discharge means 2, as well as a plurality of discharge ports 3*a* each having aperture opening to each of the grooves formed on the ceiling plate. With the ceiling plate 3 being bonded to the silicon substrate 1, each of the discharge means 2 is partitioned by the walls between grooves on the silicon substrate 1. Then, each of the discharge means 2 is arranged for the ink flow path 4 one to one. Also, to the aluminum plate 5, a printed circuit board (not shown) is fixed to relay the driving circuit on the silicon substrate 1 and the control circuit of the ink jet recording apparatus. Then, the terminals of the printed-circuit board and the terminals of the silicon substrate 1 are electrically connected through bonding wires.

Figure 2:
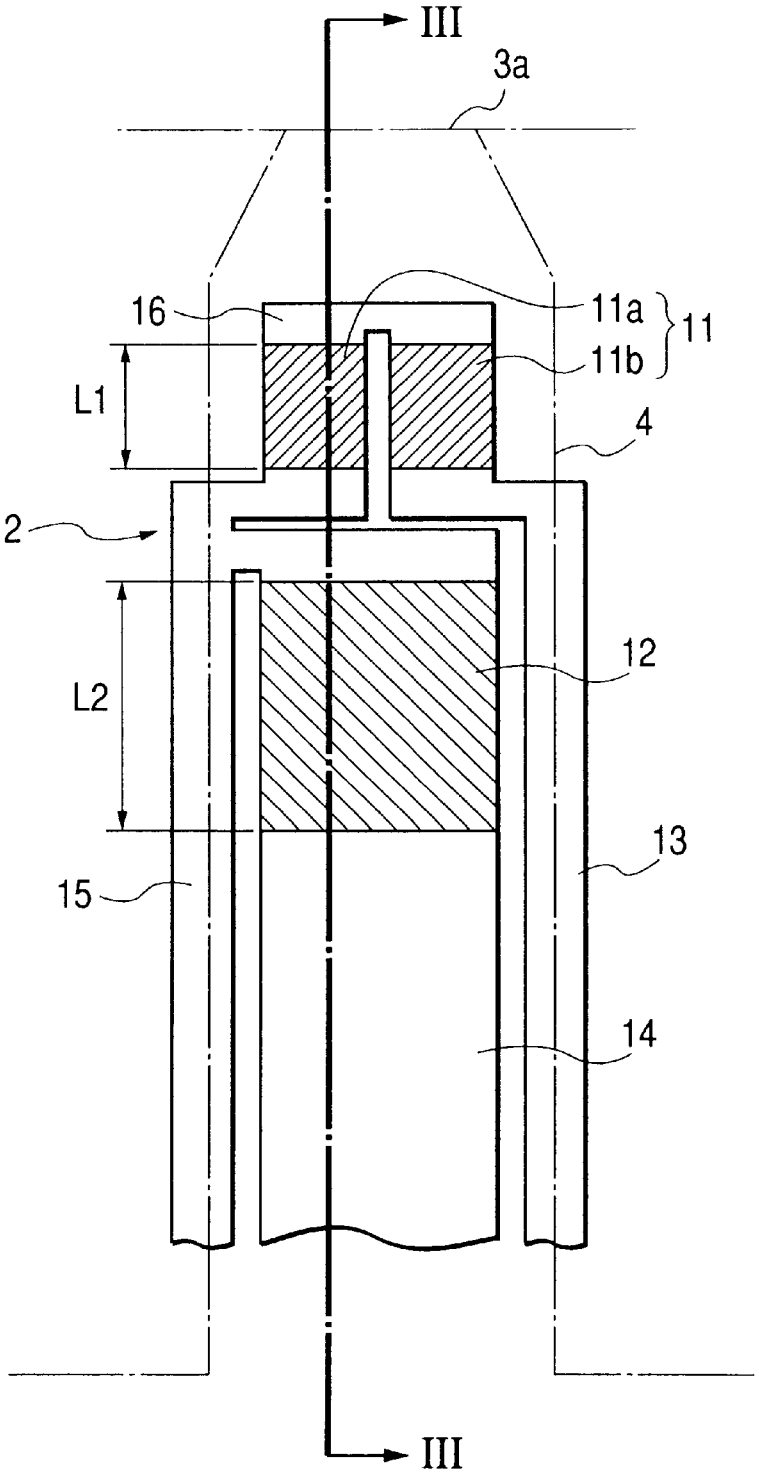
FIG. 2 is a plan view which illustrates the structure of discharge means shown in FIG. 1.

Here, with reference to FIG. 2, the description will be made of the structure of the discharge means 2. FIG. 2 is a plan view which illustrates the structure of the discharge means 2. As shown in FIG. 2, the discharge means 2 comprises first heat generating means 11 provided with a first heat generating resistive member 11*a* and a second heat generating resistive member 11*b*, and second heat generating means serving as a heat generating resistive member 12. The first heat generating means 11 and the heat generating member 12 are arranged serially in that order from the discharge port 3*a* side along the flow path 4 in the flow path direction of the ink flow path 4. The end portion of the first heat generating resistive member 12 on the heat generating means 11 side is connected electrically with the common wiring 15. The end portion of the heat generating resistive member 12 on the side opposite to the first heat generating means 11 side is electrically connected with the second individual wiring 14. The sheet resistive values of the first heat generating means 11 and the heat generating resistive member 12 are substantially the same.

The first heat generating resistive member 11*a* and the second heat generating resistive member 11*b* are configured to be rectangular, respectively. The first heat generating resistive member 11*a* and the second heat generating resistive member 11*b* are arranged in the direction perpendicular to the flow path direction of the ink flow path 4, that is, arranged in parallel in the width direction of the ink flow path 4 so that the first heat generating resistive member 11*a* and the second heat generating resistive member 11*b* are parallel to the flow path direction of the ink flow path 4 in the longitudinal direction of each of them. In this way, it becomes possible to widen the free bubbling width of the first heat generating means 11 in order to enhance the discharge stability of the smaller dots. The end portions of the first heat resistive member 11*a* and the second heat generative resistive member 11*b* on the discharge 3*a* side are electrically connected with each other through the connecting wire 16. The end portion of the first heat generating resistive member 11*a* on the heat generating resistive member 12 side is electrically connected with the common wiring 15, and the second heat generating resistive member 11*b* on the heat generating resistive member 12 side is electrically connected with the individual wiring 13. With the discharge means 2 thus arranged, it is possible to drive each of the first heat generating means 11 and the heat generating resistive member 12 individually. Here, the phrase "the free bubbling width of heat generating means" referred to in the specification of the invention hereof indicates the maximum development width of a bubble which is bubbled by heat generating means in the state where there is essentially no fluid resistive component on the circumference thereof.

As the structural material of the first heat generating resistive member 11*a*, the second heat generating resistive member 11*b*, and the heat generating resistive member 12, TaSiN is used. In place of the TaSiN, it may be possible to use either one of TaN, TaAl, $HfB_2$ and the like.

The heat generating resistive member 12 can be driven by the application of voltage across the common wiring 15 and the second individual wiring 14. The first heat generating means 11 can be driven by the application of voltage across the common wiring 15 and the first individual wiring 13. Also, if voltage is applied across the common wiring 15 and the second individual wiring 14, and across the common wiring and the first individual wiring 13 simultaneously, the first heat generating means 11 and the heat generating resistive member 12 can be driven at the same time. Also, for the purpose to adjust the discharge characteristics, it is effective to deviate the driving timing by several $\mu$sec between the first heat generating means 11 and the second heat generating member 12 which serves as the second heat generating means. Here, by making the distance between the first heat generating means 11 and the heat generating resistive member 12 smaller, while setting it at a predetermined value, it becomes possible to create one integrated bubble reliably when both of them are driven simultaneously. In this manner, therefore, it is possible to modulate the discharge amount of ink in three different ways depending on which one of the heat generating means is driven. With the case where no discharge is made, the modulation is possible in four different ways.

The configurations and sizes of the first heat generating resistive member 11*a* and the second heat generating resistive member 11*b* are the same, and the total area of the first heat generating resistive member 11*a* and second heat generating resistive member 11*b* is smaller that the area of the heat generating resistive member 12. The length $L_2$ of the heat generating resistive member 12 in the flow path direction of the ink flow path 4 is almost two times the length $L_1$ of the first heat generating resistive member 11*a* and the second heat generating resistive member 11*b*, that is, substantially the same as the total length of the first heat generative resistive member 11*a* and the second heat generating resistive member 11*b* in the flow path direction of the ink flow path 4.

Figure 3:
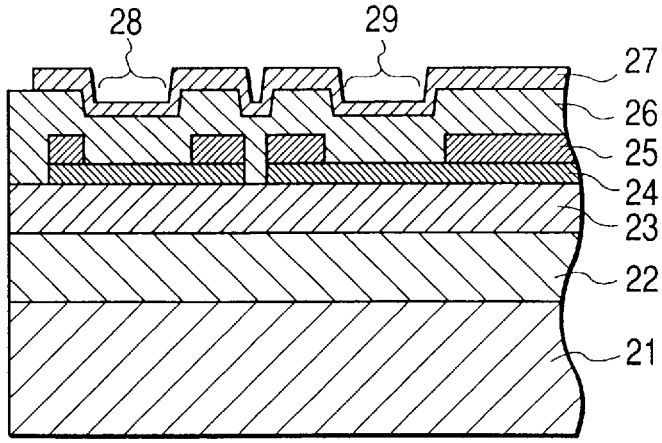
FIG. 3 is a cross-sectional view taken along line III—III in FIG. 2.

FIG. 3 is a linear cross-sectional view taken along line III—III in FIG. 2. The substrate 6 for use of the ink jet head that constitutes the ink jet head of the present embodiment is formed by the $SiO_2$ heat accumulating layer 22 produced in a film thickness of 1.8 $\mu$m by the thermal oxidation method, the sputtering method, the CVD method, or the like on the surface of the Si substrate 21 of monocrystal silicon as shown in FIG. 3. On the surface of the heat accumulating layer 22, the $SiO_2$ interlayer insulation film 23 is formed by the plasm CVD method or the like in a film thickness of 1.2 $\mu$m. On the surface of the interlayer insulation film 23, the Ta—Si—N heat generating resistive layer 24 is locally formed by the reactive sputtering method using the Ta—Si alloy target. On the surface of the heat generating resistive layer 24, The Al film 25 is locally formed by the sputtering method in a film thickness of 5500 Å.

As the method for forming the heat generating resistive layer 24 and the Al film 25, the interlayer insulation film 23 is formed, at first, on the entire surface of the heat accumulating layer 22. Then, on the enter surface of the interlayer insulation film 23, the Al film 25 is formed. After that, by use of the photolithographic method, patterning is carried out on the surface of the Al film 25. Subsequently, by etching, the heat generating resistive layer 24 and the Al film 25 are removed at a time. Then, as shown in FIG. 2, there are formed the first individual wiring 13, the second individual wiring 14, the common wiring 15, the connection wiring 16, the first heat generating means 11, and the heat generating resistive member 12. After that, the Al film 25 on the first heat generating means 11 and the heat generating resistive member 12 is etched to form the first heat generating unit 28 and the second heat generating unit 29.

On the surface of the Al film 25, the heat generating resistive layer 24, and the interlayer insulation film 23, the SiN insulating protection film 26 is formed by the plasma CVD method in a film thickness of 1 $\mu$m. Further, on the surface of the protection film 26, the Ta cavitation proof layer 27 is formed by the sputtering method in a film thickness of 2300 Å. Here, the cavitation proof film 27 is patterned by use of the photolithographic method to produce the substrate 6 for use of the ink jet head described in conjunction with FIG. 2 and FIG. 3. Now, by use of the substrate 6 for use of an ink jet head structured and produced as described above, the ink jet head shown in FIG. 1 is manufactured to evaluate the characteristics by discharging ink from the ink jet heat thereof.

Here, the first heat generating resistive member 11*a* and the second heat generating member 11*b* which serve as the first heat generating means 11 re configured to be 15×45 (μm). The heat generating resistive member 12 which serves as the second heat generating means is configured to be 40×90 (μm). Then, 300 ink flow paths 4 are formed in the flow path width of 55 μm in a flow path density of 360 dpi for the ink flow path 4.

The discharge characteristics of the ink jet head 6 of the present embodiment are evaluated with a continuous discharge for driving only the first heat generating means 11 to discharge smaller dots, and driving the first heat generating means 11 and the heat generating resistive member 12 simultaneously to discharge larger dots at the driving voltage $VP_{op}=1.3\times V_{th}$ ($V_{th}$:bubbling initiation voltage) in the pulse width of 4 μsec, while the driving frequencies are changed from 1 to 9 kHz. As a result, the smaller dots and the larger dots are both discharged stably even at the frequency higher than 4 kHz. Also, bubbling is made in a state where the first heat generating means 11 and the flow path walls are absent. Then, the free bubbling width is measured. The measured value of the free bubbling width is beyond the width of the flow path.

Figure 11:
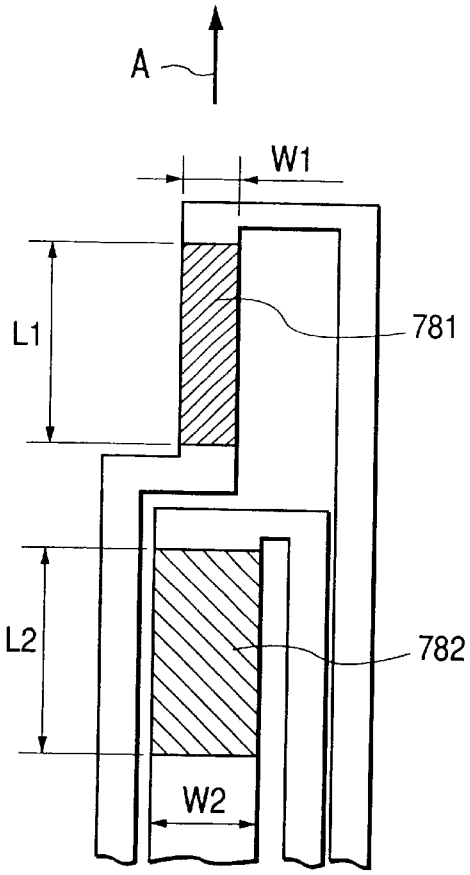
FIG. 11 is a plan view which illustrates the example of the ink jet head having the first and second heat generating elements formed on the substrate substantially in the same sheet resistance value.
Figure 12:
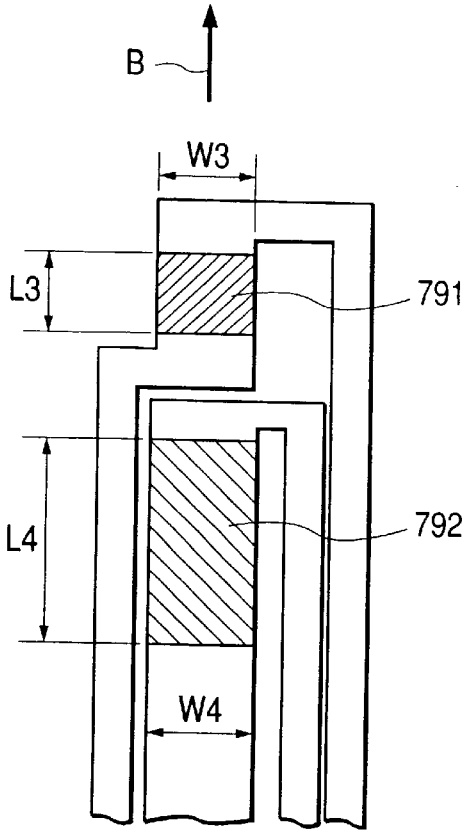
FIG. 12 is a plan view which illustrates the example of the ink jet head having the first and second heat generating elements formed on the substrate with the different heat generating resistive layers.
Figure 13:
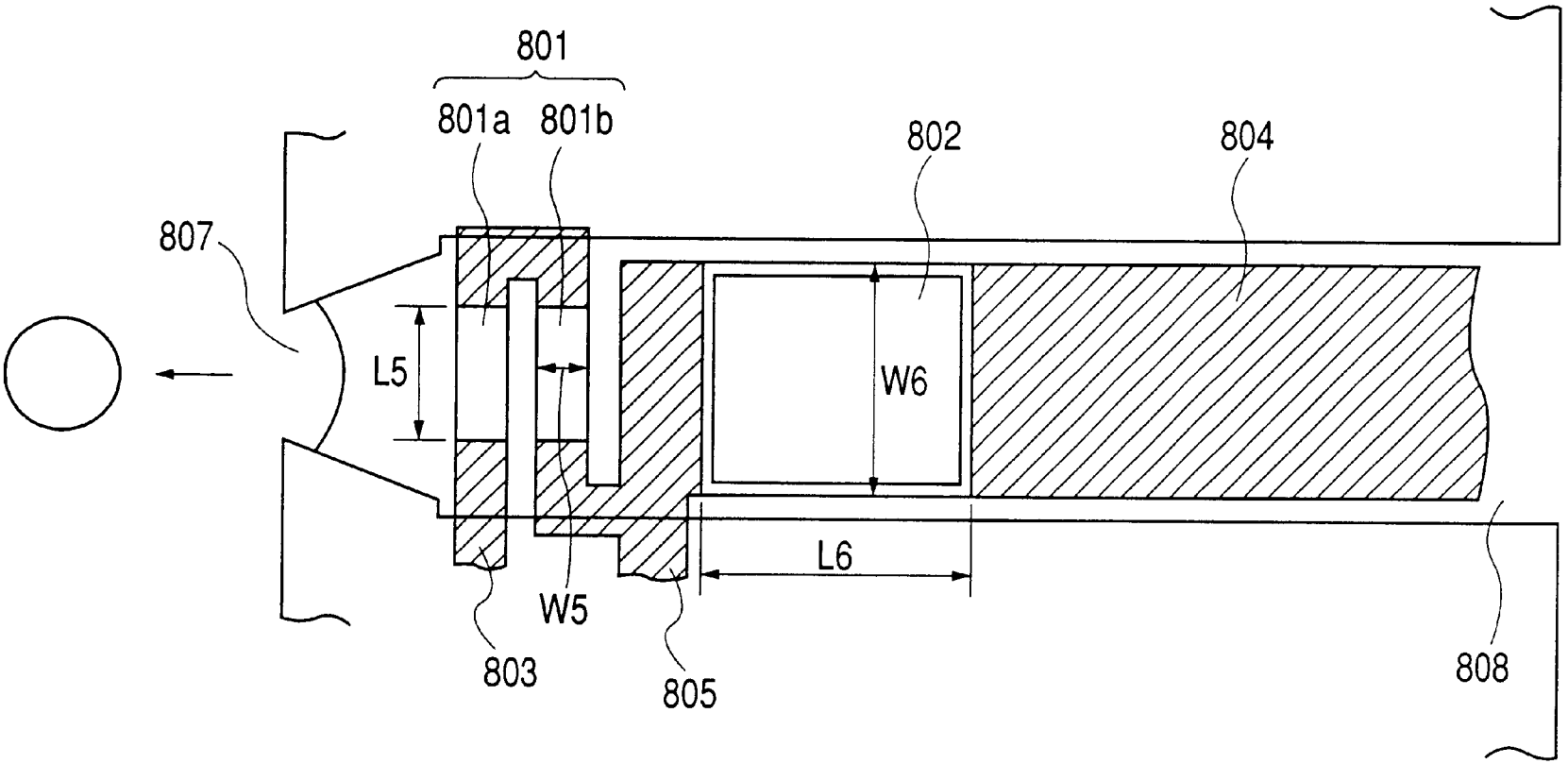
FIG. 13 is a plane view which illustrates the conventional ink jet head.

As the comparative example of the ink jet head 6 of the present embodiment, the substrate for use of an ink jet head, which is described in conjunction with FIG. 11 for the conventional art, is manufactured in the same method used for manufacturing the substrate 6 for use of an ink jet head of the present embodiment with the exception of the first heat generating means 11 which is prepared as an independent heat generating resistive member of 15×90 (μm). Then, The ink jet head is manufactured by use of this comparative example of the substrate for use of an ink jet head in order to make the evaluation of the discharge characteristics in the same manner as to the one manufactured in accordance with the present embodiment. In this case, the stable discharges are possible at the lower frequencies up to approximately 4 kHz, but it is impossible to execute the sufficiently stabilized multi-valued recording, because the discharges fluctuate in the continuous discharges at a driving frequency of as high as 9 kHz.

As described above, for the ink jet head of the present embodiment, the first heat generating means 11 and the heat generating resistive member 12 are serially arranged in the flow path direction of the ink flow path 4, and the first heat generating means 11 is arranged in the direction perpendicular to the flow path direction of the ink flow path 11. More specifically, this heat generating means is structured by the first heat generating resistive member 11*a* and the second heat generating resistive member 11*b* arranged in parallel in the width direction of the ink flow path 11. In this way, it becomes possible to make the length of the first heat generating means 11 essentially shorter in the flow path direction. Also, the width of each of the heat generating resistive members of the first heat generating means 11 can be made wider. As a result, the first heat generating means 11 can be located nearer to the nozzle walls, and also, the first heat generating means 11 and the heat generating resistive member 12 can be arranged nearer to the discharge port 3*a* along the ink flow path 4, hence reducing the fluid resistance toward the discharge port 3*a* to implement the stabilization of discharges when the head should be driven at higher frequencies for the execution of a multi-valued recording.

Further, each of the heat generating resistive members that form the first heat generating means 11 is arranged in parallel to the direction perpendicular to the flow path direction. As a result, the connection wiring 16 that connects these heat generating resistive members themselves can be arranged on the discharge port side of the first heat generating means 11 to make it possible to reduce the number of winging that should be arranged in the width direction of the ink flow path 4 as compared with the case where each of the heat generating resistive members of the first heat generating means 11 are arranged in parallel to the flow path direction. Therefore, the width of each heat generating resistive member can be made larger in relation to the width of the ink flow path 4, hence implementing the stabilization of discharges. Also, it becomes possible to attain the provision of higher density of the ink flow paths 4, and heat generating members as well.

Furthermore, since the width of each heat generating resistive member can be made larger, it becomes possible to arrange the first heat generating means 11 and the heat generating resistive member 12 more closely to the discharge port 3*a* side. This arrangement that makes it possible to locate the first heat generating means 11 and the heat generating resistive member 12 more closely to the discharge port 3*a* side along the ink flow path 4 indicates that the arrangement, configuration, and size of each heat generating member can be changed within a range that does not lower its discharge characteristics. In other words, it becomes possible to enhance the freedom in designing the heat generating resistive members in for the attainment of a multi-valued recording. In this manner, it becomes possible to increase the designing freedom in consideration of the balance between each of the heat generating means up to the increased freedom as to the arrangement and structure of the first heat generating means 11 and the heat generating resistive member 12. Consequently, in addition to the stabilized liquid discharges for a multi-valued recording, the heat generating resistive members and liquid flow paths can be arranged in higher density. Further, as the structural material of the first heat generating means 11 and the heat generating resistive member 12, those having almost the same sheet resistance value is used unlike the conventional one where a plurality of heat generating resistive members are adopted with different sheet values. As a result, it becomes possible to suppress the manufacturing costs of the substrate for use of an ink jet head, the ink jet head, and the ink jet cartridge.

(Second Embodiment)

Figure 4:
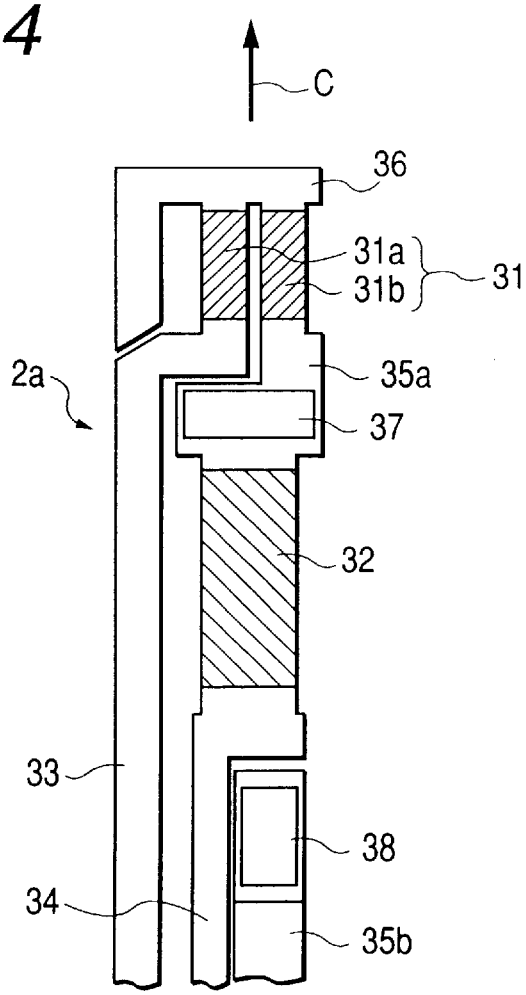
FIG. 4 is a plan view which illustrates the ink jet head in accordance with a second embodiment of the present invention.

FIG. 4 is a plan view which illustrates the ink jet head in accordance with a second embodiment of the present invention. The ink jet head of the present embodiment has the different structure of discharge means formed on the substrate from the one described in the first embodiment. FIG. 4 shows the structure of the discharge means provided for the structure for use of an ink jet head that constitutes the ink jet head of the present embodiment.

The substrate for use of an ink jet head that constitutes the ink jet head of the present embodiment is formed so as to arrange the first heat generating means 31 and the heat generating resistive member 32 which serves as the second heat generating means are arranged in series as shown in FIG. 4. As in the first embodiment, the first heat generating means 31 and the heat generating resistive member 32 are serially arranged along the ink flow path in that order from the discharge port side in the ink flow path of the ink jet head. In FIG. 4, the direction indicated by an arrow C is the ink discharge direction. The end portion of the heat generating resistive member 32 on the side opposite to the first heat generating means 31 side is electrically connected with the second individual wiring 34. The end portion of the heat generating resistive member 32 on the heat generating means 31 side is electrically connected with the common wiring 35*a* formed between the heat generating resistive member 32 and the second heat generating resistive member 31*b*.

On the portion of the substrate for use of an ink jet head that corresponds to the common wiring 35*a*, the first through hole 37 is formed. As described later in conjunction with FIGS. 5A and 5B, the common wiring layer is formed through the insulating layer on the reverse side of the first heat generating means 31 and the heat generating resistive member 32 for the substrate for use of an ink jet head in accordance with the present embodiment. Then, the common wiring layer is electrically connected with the first through hole 37. Also, on the rear end of the heat generating resistive member 32, the common wiring 35*b* is formed. Then, on the portion of the common wiring 35*b* on the heat generating resistive member 32 side, the second through hole 38 is formed. The second through hole 38 is electrically connected with the aforesaid common wiring layer on the reverse side of the heat generating resistive member 32. Thus, each of the common wiring 35*a* and 35*b* is electrically connected through the first through hole 37, the common wiring layer and the second through hole 38.

The first heat generating resistive member 31*a* and the second heat generating resistive member 31*b* are configured to be rectangular, respectively. The first heat generating resistive member 31*a* and the second heat generating resistive member 31*b* are arranged in the direction perpendicular to the flow path direction of the ink flow path, that is, arranged in parallel in the width direction of the ink flow path so that the first heat generating resistive member 31*a* and the second heat generating resistive member 31*b* are parallel to the flow path direction of the ink flow path in the longitudinal direction of each of them. The end portions of the first heat resistive member 31*a* and the second heat generative resistive member 31*b* on the discharge side are electrically connected with each other through the connecting wire 36. The end portion of the first heat generating resistive member 31*a* on the heat generating resistive member 32 side is electrically connected with the first individual wiring 33, and the second heat generating resistive member 31*b* on the heat generating resistive member 32 side is electrically connected with the common wiring 35*a*. With the discharge means 2*a* thus arranged, it is possible to drive each of the first heat generating means 31 and the heat generating resistive member 32 individually.

The configurations and sizes of the first heat generating resistive member 31*a* and the second heat generating resistive member 31*b* are the same, and the total area of the first heat generating resistive member 31*a* and second heat generating resistive member 31*b* is smaller that the area of the heat generating resistive member 32. The length of the heat generating resistive member 32 in the flow path direction of the ink flow path is almost two times the length of the first heat generating resistive member 31*a* and the second heat generating resistive member 31*b*.

Figure 5A:
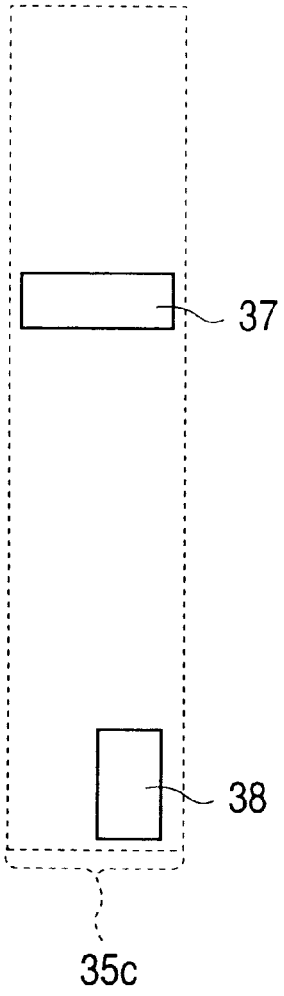
FIGS. 5A and 5B are views which illustrate the method for forming the through holes, the common wiring, and individual wiring shown in FIG. 4.
Figure 5B:
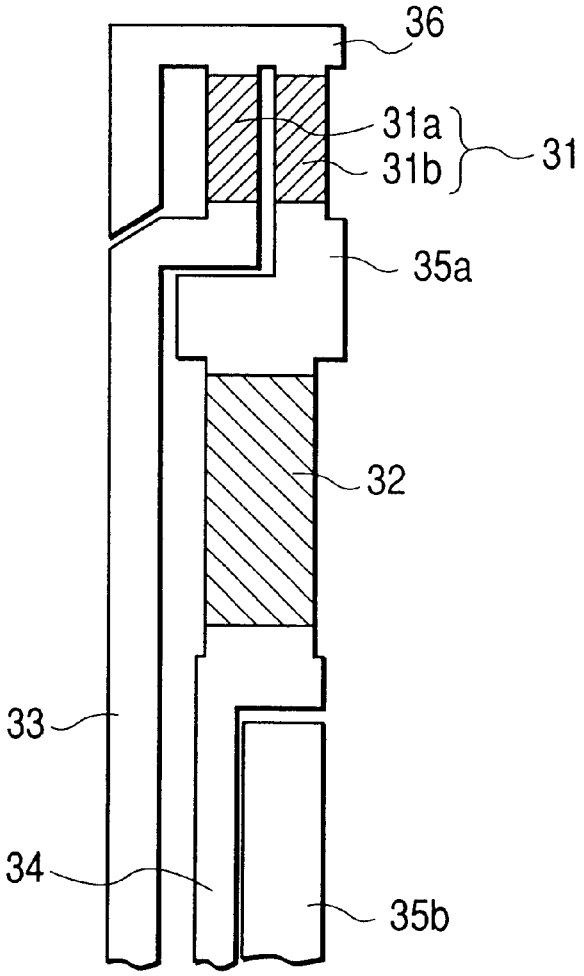

FIGS. 5A and 5B are views which illustrate the method for forming the contact through hole, the common wiring and the individual wiring in order to attain the higher density of the second means 2*a*. FIG. 5A is a plane view which shows the common wiring layer formed on the reverse side of the heat generating resistive member through the insulating layer. FIG. 5B is a plan view which shows the patterns of the common wiring and the individual wiring shown in FIG. 4.

As shown win FIG. 5A, after the common wiring layer 35*c* is formed on the silicon substrate, the insulating layer is formed on the common wiring layer 35*c* to cover the common wiring layer 35*c*. Then, the insulating layer is etched to form the first contact through hole 37 and the second through hole 38. Also, as shown in FIG. 5B, the Al film formed on the surfaces of the first heat generating means 31 and the heat generating resistive member 32, as well as on the surface of the insulating layer on the common wiring layer 35*c* is patterned to form the first individual wiring 33, the second individual wiring 34, each of the common wiring 35*a* and 35*b*, and the connecting wiring 36 on the surface of the insulating layer.

With the discharge means 2*a* thus structured as described above, it becomes possible to form the first and second heat generating means against the narrower nozzle width to cope with the required higher density arrangement. Also, the structure is adopted so that the first heat generating means 31 and the heat generating resistive member 32 are arranged serially on the common wiring layer with the first through 37 located between the first heat generating means 31 and the heat generating resistive member 32. As a result, it becomes possible to demonstrate the effect described for the first embodiment, because the heat generating means 31 and the heat generating resistive member 32 can be located more closely to the discharge port in the restricted width of the liquid flow path.

Moreover, as compared with the first embodiment, the number of wires to be arranged in the width direction of the ink flow path can be made smaller on the heat generating resistive member 32 on the side portion side. Therefore, it is possible to make the width of each of the heat generating resistive members wider to that extent with respect to the width of the liquid flow path, hence implementing more stable discharges, and also, attaining the provision of the ink flow paths and the heat generating resistive members in higher densities.

Figure 6:
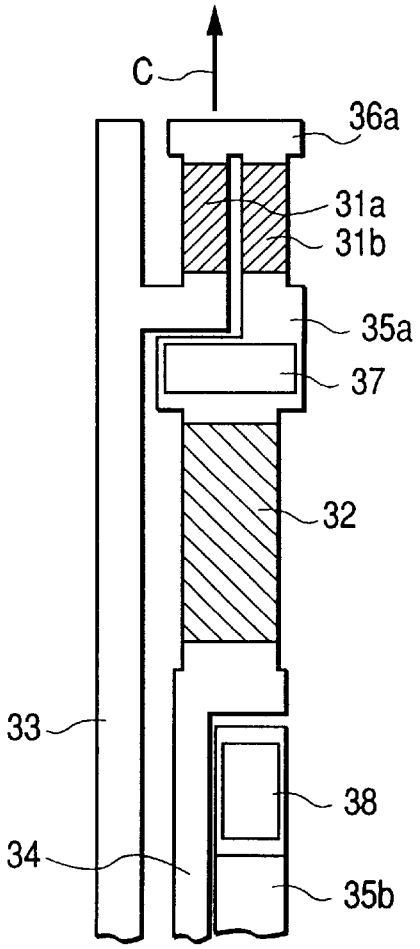
FIG. 6 is a plan view which shows the variational example of the discharge means 2*a* represented in FIGS. 5A and 5B.
Figure 7:
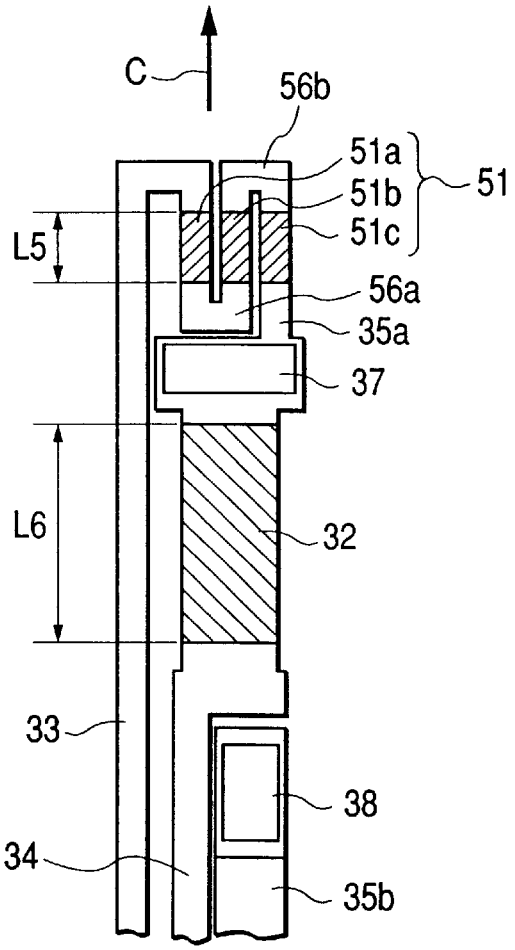
FIG. 7 is a plan view which illustrates the ink jet head in accordance with a third embodiment of the present invention.

FIG. 6 is a plan view which shows the variational example of the discharge means 2*a* represented in FIGS. 5A and 5B. The discharge means shown in FIG. 6 has the different connecting wiring from the one arranged for the discharge means 2*a* shown in FIGS. 5A and 5B, which electrically connects the first heat generating resistive member 31*a* and the second heat generating resistive member 31*b*. As shown in FIG. 6, there is formed the connecting wiring 36*a* that electrically connects the first heat generating resistive member 31*a* and the second heat generating resistive member 31*b*. Then, the configuration of the connecting wiring 36*a* is linearly symmetrical to the line extended in parallel to the first heat generating resistive member 31*a* and the second heat generating resistive member 31*b* which runs through the center of the first heat generating resistive member 31*a* and the second heat generating resistive member 31*b*. With the electrical connection being made through such connecting wiring 36*a*, it becomes possible to make the heat distribution even for each of the first heat generating resistive member 31*a* and the second heat generating resistive member 31*b* respectively. Also, the ceiling plate having the grooves that become the ink flow paths is arranged on the substrate for use of an ink jet head with discharge means as shown in FIG. 7. Then, when the flow path walls of the ceiling plate are closely bonded to the first individual wiring 33, it becomes possible to improve the contactness between the ceiling plate and the substrate for use of an ink jet head, because there is no steps created on the way of the first individual wiring 33 at all. As a result, discharge are more stabilized. Here, the structure described above is to arrange the first heat generating resistive member and second heat generating resistive member in the direction perpendicular to the direction in which the flow path is extended. However, the present embodiment is not necessarily limited to this arrangement. Here, the space equivalent to the portion of the common wiring is made available for the length of the heat generating members even if the first heat generating member and the second heat generating member are arranged along the liquid path. Therefore, even in this case, the present embodiment is more effective than the conventional structure.

(Third Embodiment)

FIG. 7 is a plan view which illustrates the ink jet head in accordance with a third embodiment of the present invention. For the ink jet head of the present embodiment, the discharge means of the first heat generating means is different from that of the second embodiment. In FIG. 7, the same reference marks are applied to the same structural parts used for the second embodiment. Hereunder, the description will be made centering on what differs from the second embodiment.

For the ink jet head of the present embodiment, the first heat generating means 51 comprising the first heat generating resistive member 51*a*, the second heat generating resistive member 51*b*, and the third heat generating resistive member 51*c* is provided as shown in FIG. 7 for the substrate for use of an ink jet head in place of the first heat generating means 31 shown in FIG. 4. The first heat generating resistive member 51*a*, the second heat generating resistive member 51*b*, and the third heat generating resistive member 51*c* are arranged in the direction perpendicular to the flow path direction of the ink flow path, that is, arranged in parallel in the width direction of the ink flow path. Each of the first heat generating resistive member 51*a*, the second heat generating resistive member 51*b*, and the third heat generating resistive member 51*c* is configured to be rectangular. Each longitudinal direction of the first heat generating resistive member 51*a*, the second heat generating resistive member 51*b*, and the third heat generating resistive member 51*c* is parallel to the ink flow path direction of the ink flow path.

The end portion of the first heat generating resistive member 51*a* on the discharge port side is electrically connected with the first individual wiring 33. The end portions of the first heat generating resistive member 51*a* and the second heat generating resistive member 51*b* on the heat generating resistive member 32 side are electrically connected themselves through the connecting wiring 56*a*. Also, the end portions of the second heat generating resistive member 51*b* and the third heat generating resistive member 51*c* on the discharge port side are electrically connected themselves through the connecting wiring 56*b*. The end portion of the third heat generating resistive member 51*c* on the heat generating resistive member 32 side is electrically connected with the common wiring 35*a*.

Each of the configuration and sizes of the first heat generating resistive member 51*a*, the second heat generating resistive member 51*b*, and the third heat generating resistive member 51*c* is the same, and the total area of the first heat generating resistive member 51*a*, the second heat generating resistive member 51*b*, and the third heat generating resistive member 51*c* is smaller than the area of the heat generating resistive member 32. The length $L_6$ of the heat generating resistive member 32 in the flow path direction of the ink flow path is made almost three times the length $L_5$ of the first heat generating resistive member 51*a*, the second heat generating resistive member 51*b*, and the third heat generating resistive member 51*c*.

With the first heat means 51 thus structured with three heat generating resistive members as described above, it becomes effective to structure this means with such material as TaN, TaAl, $HfB_2$, for example, if the material having a smaller sheet resistance value than approximately 80Ω/□ as the structural material of the heat generating resistive members.

The discharge characteristics of the ink jet head produced with the arrangement density of 400 dpi liquid flow paths using the substrate for use of an ink jet head in accordance with each of the first to third embodiments described above demonstrate stabilized discharges to make it possible to execute a multi-valued recording. Here, for the first and second embodiments, each configuration of the first heat generating resistive member and the second heat generating resistive member which serve as the first heat generating means is 10×30 (μm), and that of the heat generating resistive member which serves as the second heat generating means is 30×60 (μm).

Figure 8:
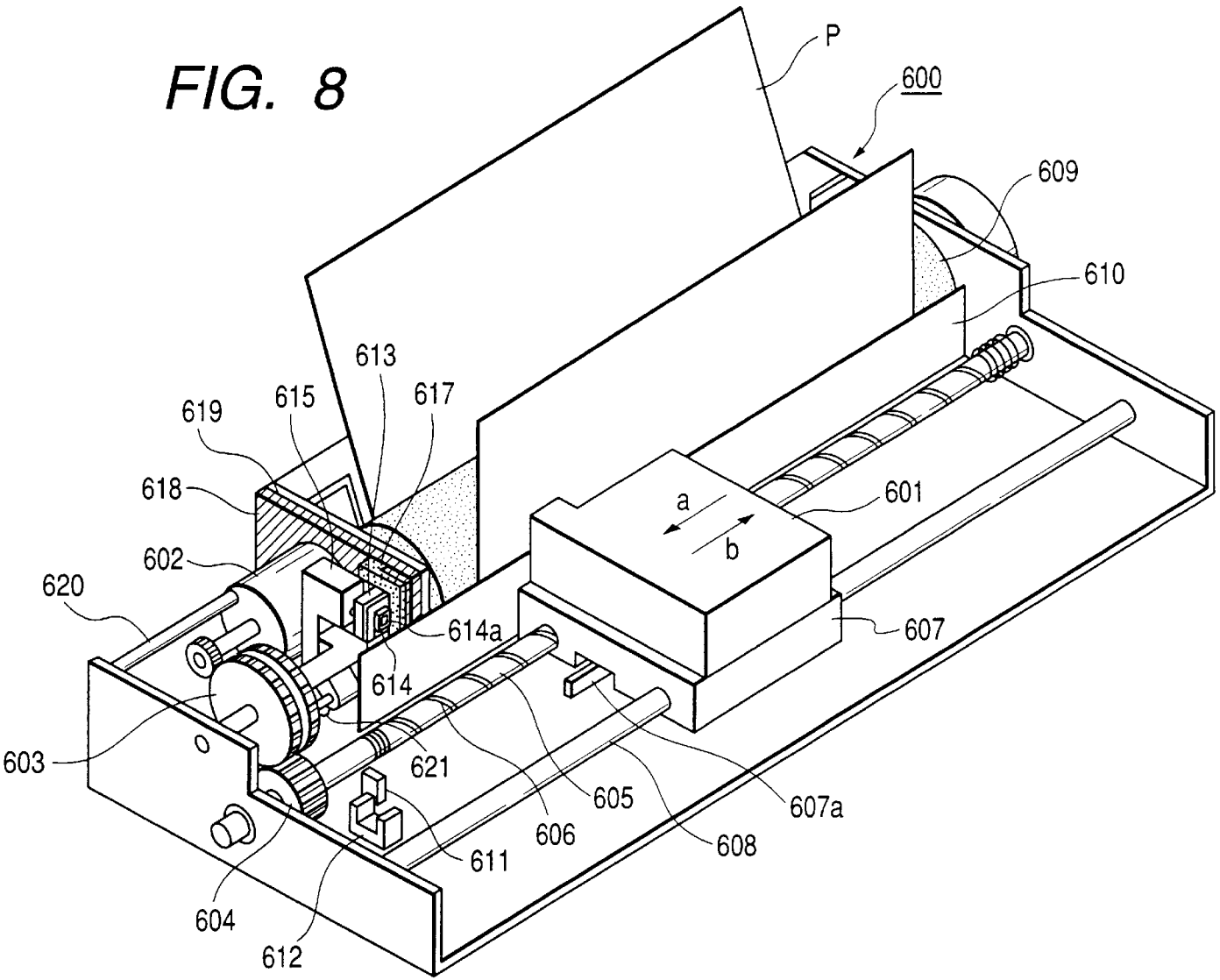
FIG. 8 is a perspective view which shows the ink jet recording apparatus that mounts on it the ink jet head.
Figure 9:
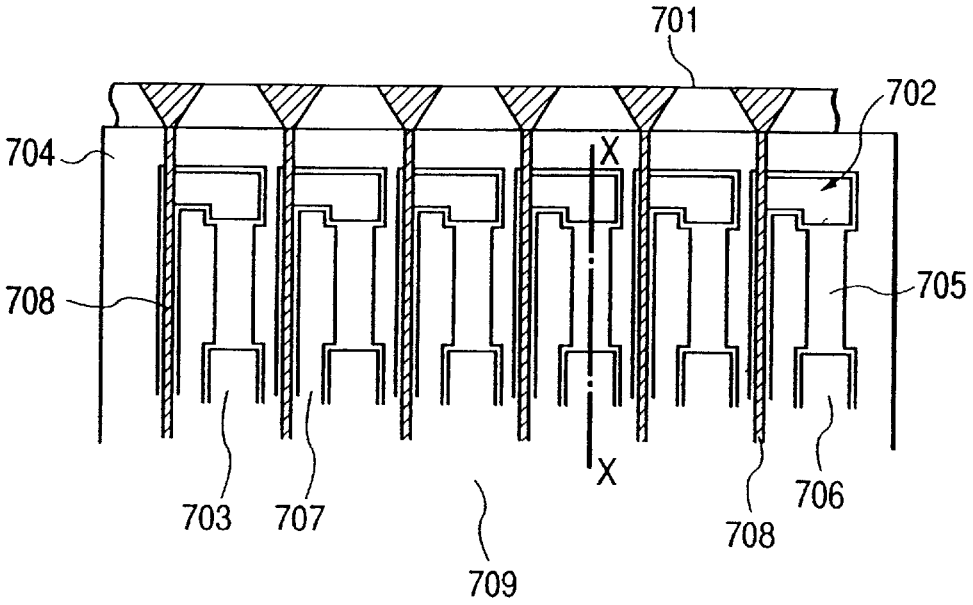
PRIOR ART FIG. 9
FIG. 9 is a cross-sectional view which illustrates the conventional ink jet head.
Figure 10:
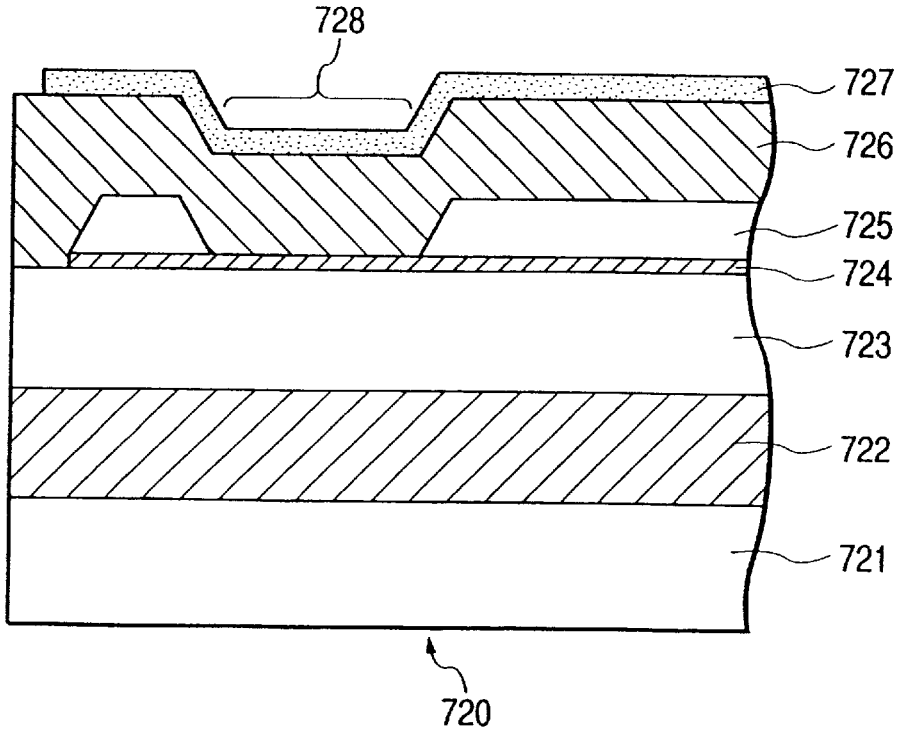
FIG. 10 is a linear cross-sectional view which shows the portion corresponding to the ink flow path of the substrate for use of an ink jet head used for the ink jet head described in conjunction with FIG. 9, taken along line X—X in FIG. 9.

FIG. 8 is a perspective view which shows the ink jet recording apparatus having mounted on it either one of the ink jet heads of the first to third embodiments described above. The head cartridge 601 mounted on the ink jet recording apparatus 600 shown in FIG. 8 is provided with either one of the ink jet heads of those of the first to third embodiments, and the liquid storing unit that stores liquid to be supplied to the ink jet head. The head cartridge 601 is mounted on the carriage, as shown in FIG. 8, which engages with the spiral groove 606 of the rotating lead screw 605 which is interlocked with the regular and reverse rotations of the driving motor 602 through the driving power transmission gears 603 and 604. The head cartridge 601 travels along the guide 608 together with the carriage 607 to reciprocate by the driving power of the driving motor 602 in the directions indicated by arrows a and b. The ink jet recording apparatus 600 is provided with a recording medium carrier device (not shown) to carry the printing sheet P which serves as the recording medium that receives liquid, such as ink, discharged from the head cartridge 601. The sheet pressure plate 610 for use of the printing sheet P, which has been carried onto the platen 609 by the recording medium carrier device, is arranged to press the printing sheet P to the platen 609 in the traveling direction of the carriage 607.

In the vicinity of one end of the lead screw 605, the photocouplers 611 and 612 are arranged. The photocouplers 611 and 612 serve as home position detecting means which recognizes the presence of the lever 607*a* of the carriage 607 in the covering region of the photocouplers 611 and 612 in order to switch the rotational directions of the driving motor 602, among some other operations. In the vicinity of one end portion of the platen 609, the supporting member 613 is provided for supporting the cap member 614 that covers the front face of the discharge ports of the head cartridge 601. Also, ink suction means 615 is provided for sucking ink retained in the interior of the cap member 614 due to the idle discharges of the head cartridge 601 or the like. The ink suction means 615 executes the suction recovery of the head cartridge 601 through the aperture portion 614*a* in the interior of the cap of the cap member 614.

The main body supporting plate 619 is arranged for the ink jet recording apparatus 600. The traveling member 618 is movably supported by the main body supporting plate 619 in the forward and backward directions, that is, movably supported in the direction at right angles to the traveling direction of the carriage 607. To the traveling member 618, the cleaning blade 617 is fixed. The cleaning blade 617 is not necessarily in this mode. It may be possible to adopt any other known modes. Further, the lever 620 is provided for initiating the suction of the suction recovery operation by use of the ink suction means 615. The lever 620 moves along with the movement of the cam 621 that engages with the carriage 607, and the movement thereof is controlled by known transmission means, such as clutch, that switches the driving power from the driving motor 602. The ink jet recording controlling unit that provides signals for the heat generating resistive members arrange for the head cartridge 601, and controls the driving of each of the mechanisms described above is arranged for the ink jet recording apparatus main body, which is not shown in FIG. 8.

With the ink jet recording apparatus 600 structured as described above, the head cartridge 601 executes recording while reciprocating over the entire width of the printing sheet P when the printing sheet P is carried onto the platen 609 by means of the aforesaid recording medium carrier device. Here, as the structural parts of the head cartridge 601, the substrate for use of an ink jet head described above is used. Also, since the substrate for use of an ink jet head is manufactured by the method of manufacture described above, it is possible to execute the stabilized liquid discharges even when a multi-valued recording is made, hence obtaining highly precise images recorded in high resolution at higher speeds.

In this respect, although the present invention has been described with reference to the specific embodiments described above, it is not meant to be construed in a limiting sense. Various modifications of the disclosed embodiments, as well as other embodiments of the invention, will become apparent with reference to the description of the invention. It is therefore contemplated that the appended claims will cover any modifications as fall within the true scope of the invention.

What is claimed is:

1. A substrate for an ink jet head comprising a plurality of discharge ports for discharging liquid, a plurality of liquid flow paths communicated with said plurality of discharge ports, and first and second heat generating means arranged serially in each said liquid flow path of said plurality of liquid flow paths for generating thermal energy utilized for discharging liquid in said liquid flow path from said discharge ports, and forming said first and second heat generating means on the substrate, wherein said first and second heat generating means are driven at driving frequencies of 4 kHz or more, and said first heat generating means are arranged in parallel in the direction perpendicular to the flow path direction of said liquid flow path, at the same time, being structured with a plurality of heat generating resistive members electrically connected in series, and said second heat generating means is structured with at least one heat generating resistive member.

2. A substrate for an ink jet head according to claim 1, wherein each sheet resistance value of the heat generating resistive members forming said first heat generating means, and the sheet resistance value of the heat generating resistive member forming said second heat generating means are substantially the same.

3. A substrate for an ink jet head according to claim 1, further comprising:

a common wiring layer formed on said substrate to be arranged on said substrate side of said first and second heat generating means;

an insulating layer formed on the surface of said common wiring layer to be arranged as the lower layer of said first and second heat generating means;

a first through hole formed on said insulating layer between said first and second heat generating means for electrically connecting said first and second heat generating means with said common wiring layer;

a first individual wiring formed on the surface of said insulating layer to be electrically connected with said first heat generating means;

a second individual wiring formed on the surface of said insulating layer to be electrically connected with said second heat generating means;

a common wiring arranged on the side of said second heat generating means opposite to said discharge port side; and a second through hole formed on the portion of said insulating layer corresponding to the end portion of said common wiring on said second heat generating means side to electrically connect said common wiring and said common wiring layer.

4. A substrate for an ink jet head according to claim 1, wherein said first heat generating means is arranged on the downstream side of said second heat generating means in the flow path direction of said liquid flow path.

5. A substrate for an ink jet head according to claim 1, wherein said first heat generating means is structured with first and second heat generating resistive members arranged in parallel to the direction perpendicular to the flow path direction of said liquid flow path, and said first and second heat generating resistive members are electrically connected through connecting wire arranged on the discharge port side of said first and second heat generating resistive members.

6. A substrate for an ink jet head according to claim 5, wherein the widths of said first and second heat generating resistive members are substantially the same, and said second heat generating means is formed by one heat generating resistive member, and the length of said second heat generating means in the flow path direction of said liquid low path is substantially the same as the total length of the first and second heat generating resistive members in the flow path direction of said liquid flow path.

7. A substrate for an ink jet head according to claim 1, wherein either one of TaN, TaAl, TaSiN and $HfB_2$ is used as the structural material of said first and second heat generating elements.

8. A substrate for an ink jet head according to claim 1, wherein the free bubbling width of said first heat generating means is larger than the maximum distance of said liquid flow path in the width direction of said liquid flow path on the arrangement portion of the first heat generating means.

9. A substrate for an ink jet head according to claim 1, wherein the configurations and sizes of said first heat generating resistive member and said second heat generating resistive member are substantially the same.

10. A substrate for an ink jet head constituting an ink jet head comprising a plurality of discharge ports for discharging liquid, a plurality of liquid flow paths communicated with said plurality of discharge ports, and first and second heat generating means arranged serially in each said liquid flow path for generating thermal energy utilized for discharging liquid in each said liquid flow path from said discharge ports, wherein said substrate for use of an ink jet head is provided with a common wiring layer formed on said substrate to be arranged on said substrate side of said first and second heat generating means; an insulating layer formed on the surface of said common wiring layer to be arranged as the lower layer of said first and second heat generating means; a first through hole formed on said insulating layer between said first and second heat generating means for electrically connecting said first and second heat generating means with said common wiring layer; a first individual wiring formed on the surface of said insulating layer to be electrically connected with said first heat generating means; a second individual wiring formed on the surface of said insulating layer to be electrically connected with said second heat generating means, and at the same time, said first and second heat generating means are driven at driving frequencies of 4 kHz or more, and said first heat generating means is structured with a plurality of heat generating resistive members electrically connected in series, and said second heat generating means is structured with at least one heat generating resistive member.

11. A substrate for an ink jet head according to claim 10, wherein each sheet resistance value of the heat generating resistive members forming said first heat generating means, and the sheet resistance value of the heat generating resistive member forming said second heat generating means are substantially the same.

12. A substrate for an ink jet head according to claim 10, wherein said first heat generating means is arranged on the downstream side of said second heat generating means in the flow path direction of said liquid flow path.

13. A substrate for an ink jet head according to claim 10, wherein said first heat generating means is structured with first and second heat generating resistive members arranged in parallel to the direction perpendicular to the flow path direction of said liquid flow path, and said first and second heat generating resistive members are electrically connected through connecting wire arranged on the discharge port side of said first and second heat generating resistive members.

14. A substrate for an ink jet head according to claim 13, wherein the widths of said first and second heat generating resistive members are substantially the same, and said second heat generating means is formed by one heat generating resistive member, and the length of said second heat generating means in the flow path direction of said liquid flow path is substantially the same as the total length of the first and second heat generating resistive members in the flow path direction of said liquid flow path.

15. A substrate for an ink jet head according to claim 10, wherein either one of TaN, TaAl, TaSiN and $HfB_2$ is used as the structural material of said first and second heat generating elements.

16. A substrate for an ink jet head according to claim 10, wherein the free bubbling width of said first heat generating means is larger than the maximum distance of said liquid flow path in the width direction of said liquid flow path on the arrangement portion of the first heat generating means.

17. A substrate for an ink jet head according to claim 10, wherein the configurations and sizes of said first heat generating resistive member and said second heat generating resistive member are substantially the same.

18. An ink jet head comprising:

a substrate for an ink jet head according to any one of claims 1 to 17; and a ceiling plate bonded to the surface of said substrate for use of an ink jet head on said first and second heat generating means side so as to arrange each said liquid flow path of said plurality of liquid flow paths on the surface of said substrate for use of an ink jet head on said first and second heat generating means side.

19. An ink jet cartridge comprising:

an ink jet head according to claim 18; and a liquid storing unit to store liquid to be supplied to said ink jet head.

20. An ink jet recording apparatus comprising:

an ink jet cartridge according to claim 19; and a recording medium device for carrying a recording medium to receive liquid discharged from said ink jet cartridge.

* * * * *

UNITED STATES PATENT AND TRADEMARK OFFICE

CERTIFICATE OF CORRECTION

PATENT NO. : 6,474,788 B1
DATED : November 5, 2002
INVENTOR(S) : Ichiro Saito et al.

It is certified that error appears in the above-identified patent and that said Letters Patent is hereby corrected as shown below:

Column 1,
Line 49, “crated” should read -- created --.

Column 4,
Line 28, “with” should read -- width --.

Column 5,
Line 39, “an” should read -- an object --.

Column 12,
Line 31, “plasm” should read -- plasma --.

Column 16,
Line 64, “discharge” should read -- discharges --.

Column 20,
Line 51, “constituting an ink jet” should be deleted;
Line 52, “head” should be deleted;
Line 55, “said” should be deleted;
Line 56, “path” should read -- path of said plurality of liquid flow paths --.

Column 22,
Line 34, “device” should read -- carrier device --;
Line 36, “cartridge.” should read -- head of said ink jet cartridge --.

Signed and Sealed this

Twenty-second Day of July, 2003

JAMES E. ROGAN
*Director of the United States Patent and Trademark Office*